US006377769B2

(12) United States Patent
Kakimoto

(10) Patent No.: US 6,377,769 B2
(45) Date of Patent: Apr. 23, 2002

(54) DEVELOPING APPARATUS

(75) Inventor: Hiroaki Kakimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/784,055

(22) Filed: Feb. 16, 2001

(30) Foreign Application Priority Data

Feb. 24, 2000 (JP) ..... 2000-046940

(51) Int. Cl.[7] ..... G03G 21/20; G03G 15/08
(52) U.S. Cl. ..... 399/284; 399/92
(58) Field of Search ..... 399/265, 273, 399/274, 279, 283, 284, 92

(56) References Cited

U.S. PATENT DOCUMENTS 5,937,226 A * 8/1999 Kim
6,229,980 B1 * 5/2001 Ogawa et al. ..... 399/283

* cited by examiner

*Primary Examiner*—Susan S. Y. Lee
(74) *Attorney, Agent, or Firm*—Fitzpatrick, Cella, Harper & Scinto

(57) ABSTRACT

A developing apparatus is provided in which a temperature rise of a developing blade is restrained. The developing apparatus includes a developer carrying member for carrying a developer thereon, a regulating member for regulating an amount of the developer on the developer carrying member, and a heat pipe provided along a lengthwise direction of the regulating member.

4 Claims, 4 Drawing Sheets

DEVELOPING APPARATUS

BACKGROUND OF THE INVENTION

1. Field of the Invention

This invention relates to a developing apparatus used in an image forming apparatus using the electrophotographic method or the electrostatic recording method to develop an electrostatic image on an image bearing member.

2. Related Background Art

The following known method has heretofore been used as a method of applying a developer to a developing sleeve in the developing apparatus of an electrophotographic image forming apparatus.

That is, a magnet having strong and weak magnetic fields at the circumferential positions thereof is disposed in the central portion of a developing sleeve, and a developing blade formed of a magnetic material is disposed at a position corresponding to the peak of one of these magnetic fields, and this developing blade is fixed to a developing container so as to keep a minute gap of hundreds of $\mu$m from the surface of the developing sleeve uniformly in the lengthwise direction thereof.

On the other hand, the developer in the developing container is always carried to the developing sleeve side by an agitating member in the developing container. Here, the developer comprises a magnetic material and is attracted to the surface of the developing sleeve by the magnet in the developing sleeve. The attracted developer is carried on the developing sleeve rotatively driven, and arrives at the minute gap between the developing sleeve and the developing blade, and uniformly coats the surface of the developing sleeve in this minute gap and also is frictionally charged by the frictional contact (slide) in the minute gap.

In the case of a so-called high-speed machine for achieving the higher speed of productivity, it is necessary to increase the linear speed (process speed) of an image bearing member for forming an image as a latent image and at the same time, it is also necessary to increase a speed for developing the latent image. Specifically, it is necessary to increase the linear speed of the developing sleeve. As a result, the amount of frictional contact of the developer increases in the minute gap between the developing sleeve and the developing blade, and this causes the heat generation (hereinafter referred to as the developing frictional contact heat) of the developer near the developing sleeve or on the surface of the developing sleeve.

Thus, when the high-speed electrophotographic image forming apparatus is continuously operated, the abnormal heat generation of the developer becomes more remarkable, and the deterioration of the developer progresses with endurance and this results in a reduction in developing density, and in the worst case, there arises the problem that the developer is fused onto the developing sleeve.

In order to solve the above-noted problem, there has been proposed a method of bringing a heat sink for radiation into contact with the developing blade, or forcibly cooling the developing blade by cooling means, but for example, it is not easy to uniformly cool the lengthwise direction of the heat sink for radiation by a cooling fan, and on the contrary, there is anticipated such a reverse effect of providing temperature unevenness.

SUMMARY OF THE INVENTION

It is an object of the present invention to provide a developing apparatus in which the temperature rise of a developing blade is restrained.

It is another object of the present invention to provide a developing apparatus in which the temperature unevenness of a developing blade is prevented.

It is still another object of the present invention to provide a developing apparatus comprising:

- a developer carrying member for carrying a developer thereon;
- a regulating member for regulating an amount of the developer on the developer carrying member; and
- a heat pipe provided along a lengthwise direction of the regulating member.

Further objects of the present invention will become apparent from the following description.

DESCRIPTION OF THE PREFERRED EMBODIMENTS

Some embodiments of the present invention will hereinafter be described with reference to the accompanying drawings.

<Embodiment 1>

Figure 3:
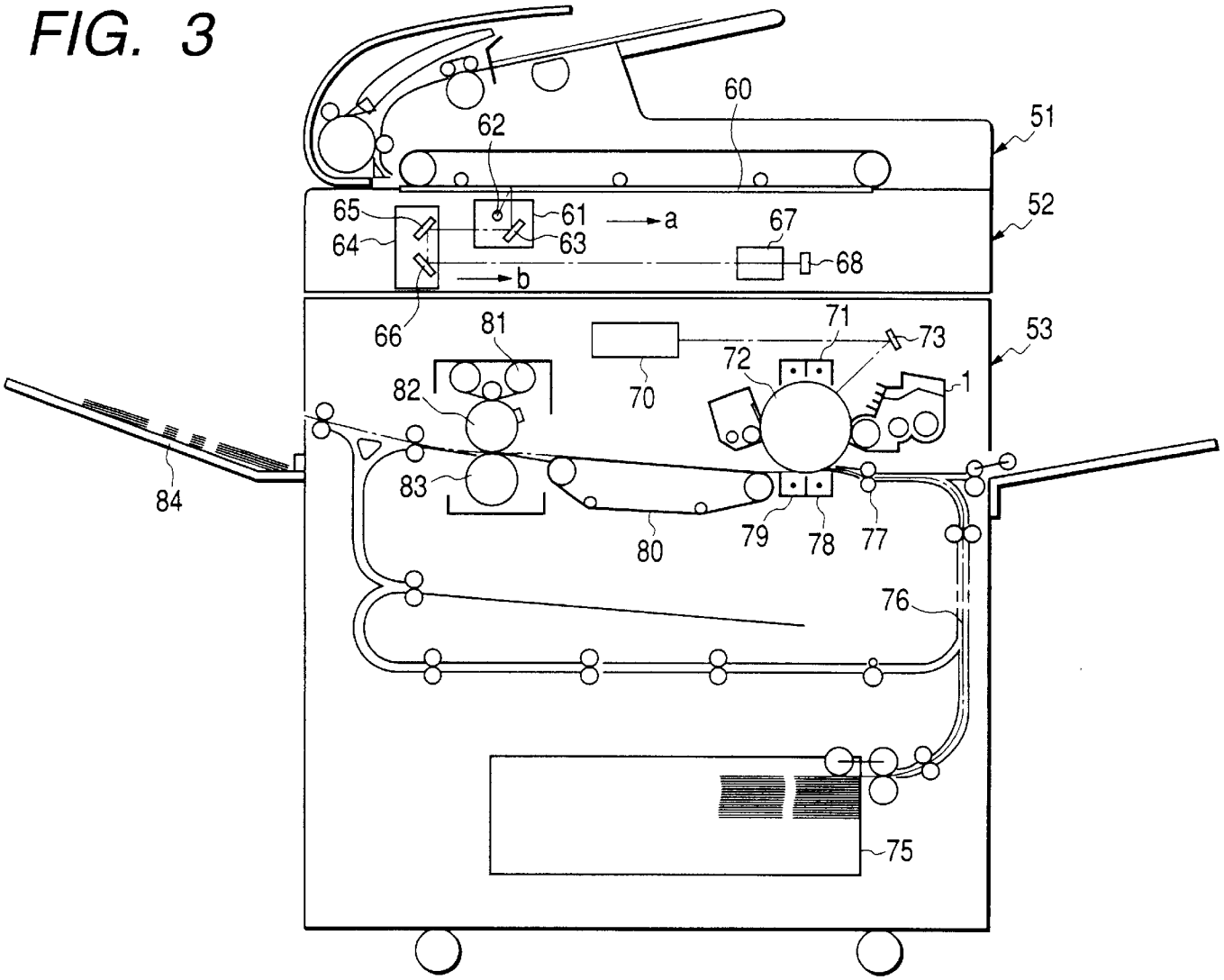
FIG. 3 is a cross-sectional view of a digital copier provided with the developing apparatus according to the present invention.

Referring to FIG. 3 which is a cross-sectional view of a digital copier provided with a developing apparatus according to the present invention, the reference numeral 51 designates an original conveying apparatus on which an original is placed, the reference numeral 52 denotes a scanner for reading the image of the original, and the reference numeral 53 designates a printer for printing the image read by the scanner 52 or information sent from a personal computer or the like through a network.

Here, a description will be made of the general copying operation of reading the image of the original on an original supporting glass table 60 supported on the upper surface of the scanner 52 and forming an image by the printer 53.

The original is irradiated by a light source 62 in a first mirror stand 61 in the scanner 52, and the image thereof is reflected by a first reflecting mirror 63 supported by the first mirror stand 61. The reference numeral 65 denotes a second reflecting mirror, and the reference numeral 66 designates a third reflecting mirror, and the two are disposed so that normals to the reflecting surfaces thereof may be orthogonal to each other, and are supported by a second mirror stand 64.

Thus, the image of the original irradiated by the first reflecting mirror 63 is reflected by the second reflecting mirror 65 and the third reflecting mirror 66, enters a condensing lens unit 67 and is further condensed on a photoelectric conversion element 68 such as a CCD.

The first mirror stand 61 reads the image of the original while being moved at a constant speed in the direction of arrow a. Likewise the second mirror stand 64 is moved in the direction of arrow b at a constant speed of ½ of the speed of the first mirror stand 61.

The printer 53 will now be described.

The reference numeral 70 designates a laser scanner for modulating the image read by the photoelectric conversion element 68 to the ON/OFF of a laser beam, and the reference numeral 71 denotes a charger which uniformly charges the surface of a photosensitive drum 72 rotated at a constant speed.

Thus, the laser beam emitted from the laser scanner 70 is reflected by a reflecting mirror 73, and forms an electrostatic latent image on the surface of the photosensitive drum 72, and this electrostatic latent image is developed by the developer of a developing apparatus 1 according to the present invention.

On the other hand, paper fed from a paper feeding deck 75 passes along a conveying path 76, and is conveyed to the photosensitive drum 72 by a pair of registration rollers 77 in synchronism with the image developed on the photosensitive drum 72. Here, the developer on the surface of the photosensitive drum 72 is transferred onto the paper by a transferring apparatus 78. The paper carrying the transferred image thereon is then separated from the photosensitive drum 72 by a separating apparatus 79, and thereafter is sent to a fixing apparatus 81 by a conveying belt 80. The fixing apparatus 81 is comprised of a fixing roller 82 and a pressurizing roller 83 brought into pressure contact therewith, and the paper is held between the fixing roller 82 and the pressurizing roller 83 to be heated and pressurized, whereby the image thereon is fixed, and the paper on which the image has been fixed is discharged onto a discharge tray 84.

Figure 1:
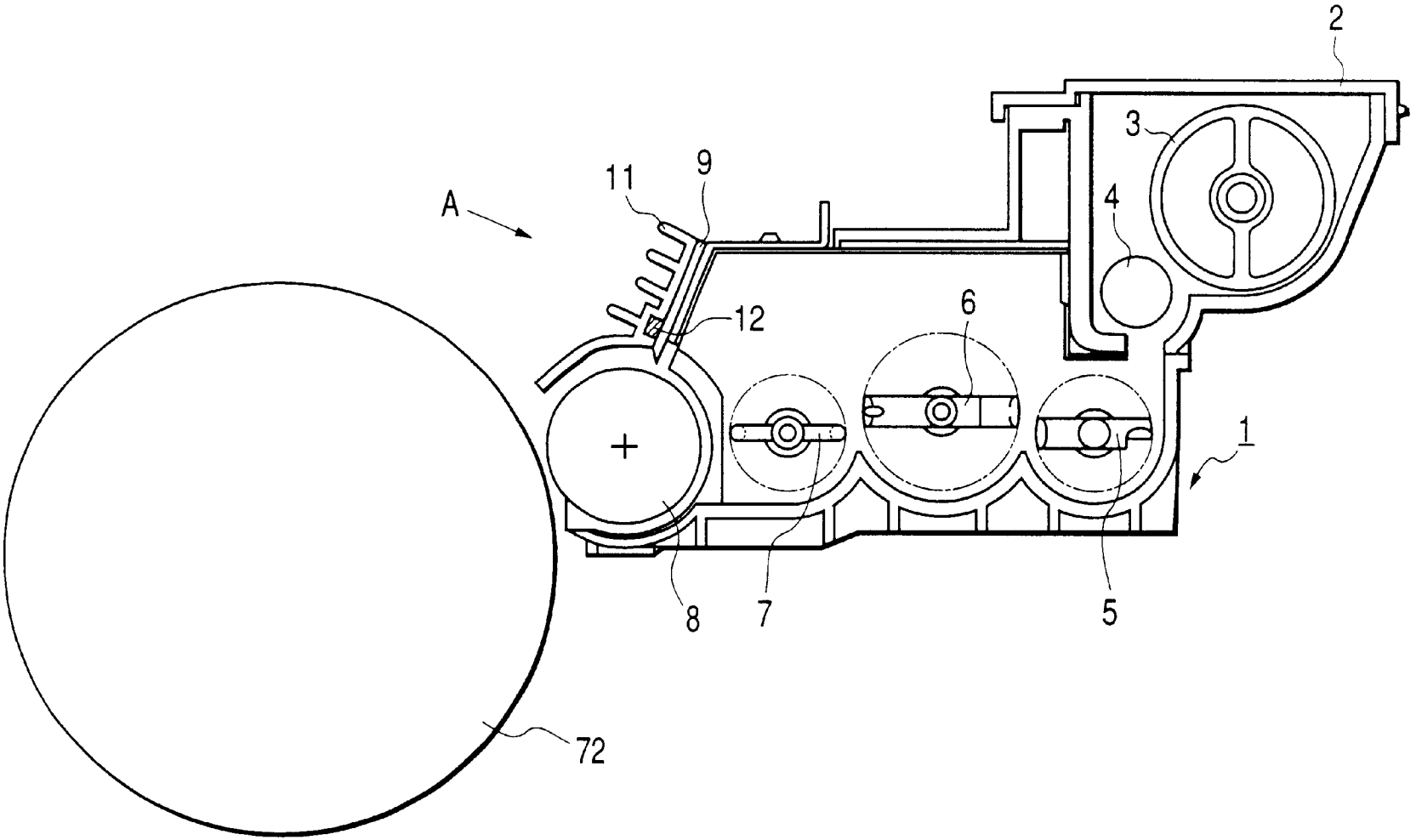
FIG. 1 is a cross-sectional view showing the construction of a developing apparatus according to Embodiment 1 of the present invention.
Figure 2:
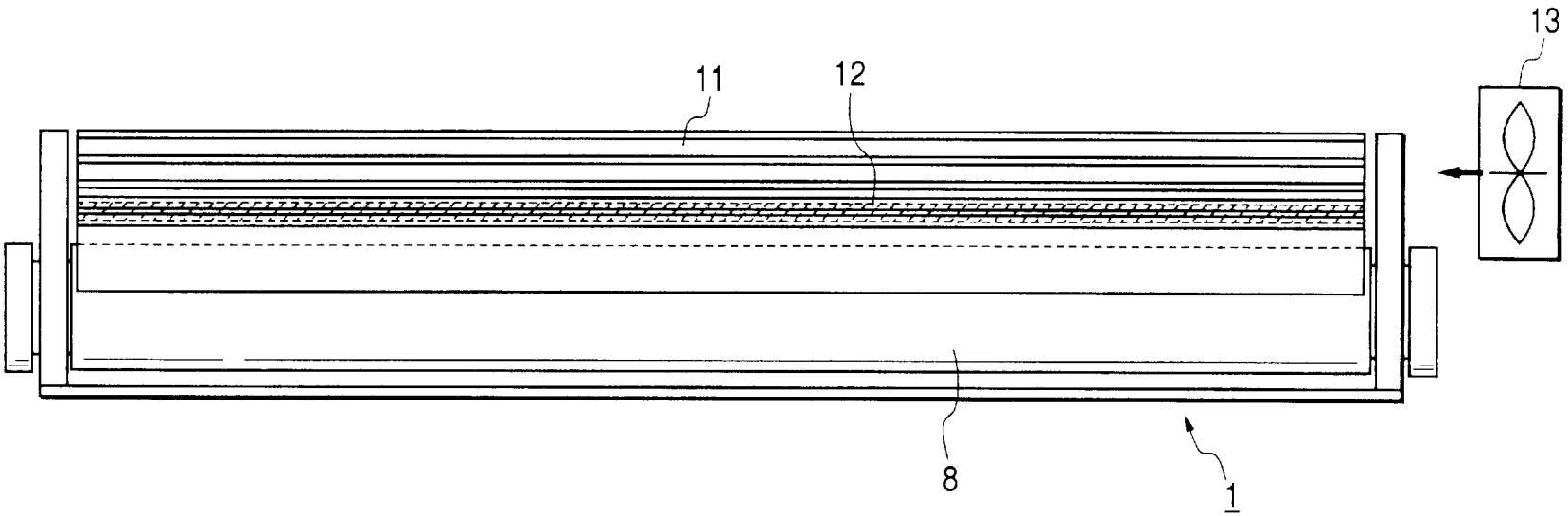
FIG. 2 is a view taken along the direction of arrow A in FIG. 1.

The developing apparatus 1 according to the present invention will now be described with reference to FIGS. 1 and 2. FIG. 1 is a cross-sectional view showing the construction of the developing apparatus 1 according to the present invention, and FIG. 2 is a view taken along the direction of arrow A in FIG. 1.

In the developing apparatus 1 according to the present invention, the reference numeral 2 designates a hopper portion for suitably supplying a developer, and this hopper portion 2 is provided with an agitating wing 3 for uniformizing a developer supplied from the outside of the apparatus into the hopper portion 2.

The reference numeral 4 denotes a magnet roller which attracts the developer comprising a magnetic material onto the surface thereof, and regulates the developer falling from the hopper portion 2 to the developing apparatus 1.

Now, in the developing apparatus 1, there is provided a known toner sensor (not shown) for always keeping the powder surface of the developer in the developing apparatus 1 at a constant level. When the powder surface of the developer becomes lower than the constant level, the lowering of the powder surface is detected by the toner sensor, and in operative association with the timing thereof, the magnet roller 4 is rotated by a rotatively driving mechanism, not shown, and by the rotation of this magnet roller 4, the developer in the hopper portion 2 falls uniformly in the lengthwise direction.

When the level of the powder surface of the developer in the developing apparatus 1 recovers to the constant level, the fall of the developer stops via a series of operations, i.e., the detection of the recovery of the powder surface by the toner sensor, the stoppage of the rotatively driving mechanism and the stoppage of the rotation of the magnet roller 4.

Also, agitators 5, 6 and 7 which are first to third developer agitating and carrying means are disposed in the developing apparatus 1 in the order from the one nearest to the hopper portion 2. In the present embodiment, the three agitators 5 to 7 are rotated at the same speed, whereby the developer supplied from the hopper portion 2 is sequentially carried to a developing sleeve 8 side.

Thus, the developer carried to the vicinity of the developing sleeve 8 is thinly applied onto the surface of the developing sleeve 8 by a developing blade 9 via a known process and at the same time, is frictionally charged. Here, a bias voltage is applied to the developing sleeve 8, and the developer thinly applied onto the developing sleeve 8 and charged develops the latent image on the photosensitive drum 72 and visualizes it.

Now, the reference numeral 11 designates a heat sink for radiation fixed in contact with the developing blade 9, and this heat sink 11 for radiation adopts a construction serving also as a cover for preventing the scattering of the developer on the developing sleeve 8, and securing the surface area thereof to the maximum. In the present embodiment, in view of performance, manufacturing cost, etc., aluminum is used as the material of the heat sink 11 for radiation. Also, a construction is adopted in which a heat pipe 12 is embedded in the heat sink 11 for radiation and the heat pipe 12 is sandwiched between the developing blade 9 and the heat sink 11 for radiation.

As shown in FIG. 2, in the present embodiment, cooling air is blown against the heat sink 11 for radiation from one end of the developing apparatus 1 by a cooling fan 13 in order to positively effect the radiation of the developing blade 9. When the cooling air is thus blown against one end of the heat sink 11 for radiation, the radiation of only that side of the heat sink 11 for radiation which is exposed to the cooling air is expedited, and there arises the possibility of causing temperature unevenness occurring in the lengthwise direction of the developing blade 9 and developing density unevenness resulting therefrom.

So, as in the present embodiment, the heat pipe 12 much better in thermal conductivity than aluminum is embedded in the interior of the heat sink 11 for radiation, whereby the responsiveness of heat uniformination in the lengthwise direction of the heat sink 11 for radiation can be improved. Incidentally, in a high-speed machine wherein the developing frictional contact heat particularly becomes a problem, the radiation effect is insufficient if a heat sink for radiation made of ordinary aluminum is merely brought into contact with the developing blade. Also, it is not easy to uniformly cool the lengthwise direction of the heat sink for radiation by a cooling fan, and on the contrary, such a reverse effect that temperature unevenness becomes great is anticipated.

On the other hand, if as in the present embodiment, the heat sink 11 for radiation, the heat pipe 12 and the cooling fan 13 are used together, the developing blade 9 can be cooled to thereby uniformize the temperature in the lengthwise direction thereof.

<Embodiment 2>

Embodiment 2 of the present invention will now be described with reference to FIG. 4.

While Embodiment 1 has been described with its application particularly to a high-speed machine kept in view, the present invention can also be applied to a medium or low speed machine in which developing frictional contact heat is not so high as in a high-speed machine, but heat is generated to such a degree as will affect the developing performance after endurance.

Figure 4:
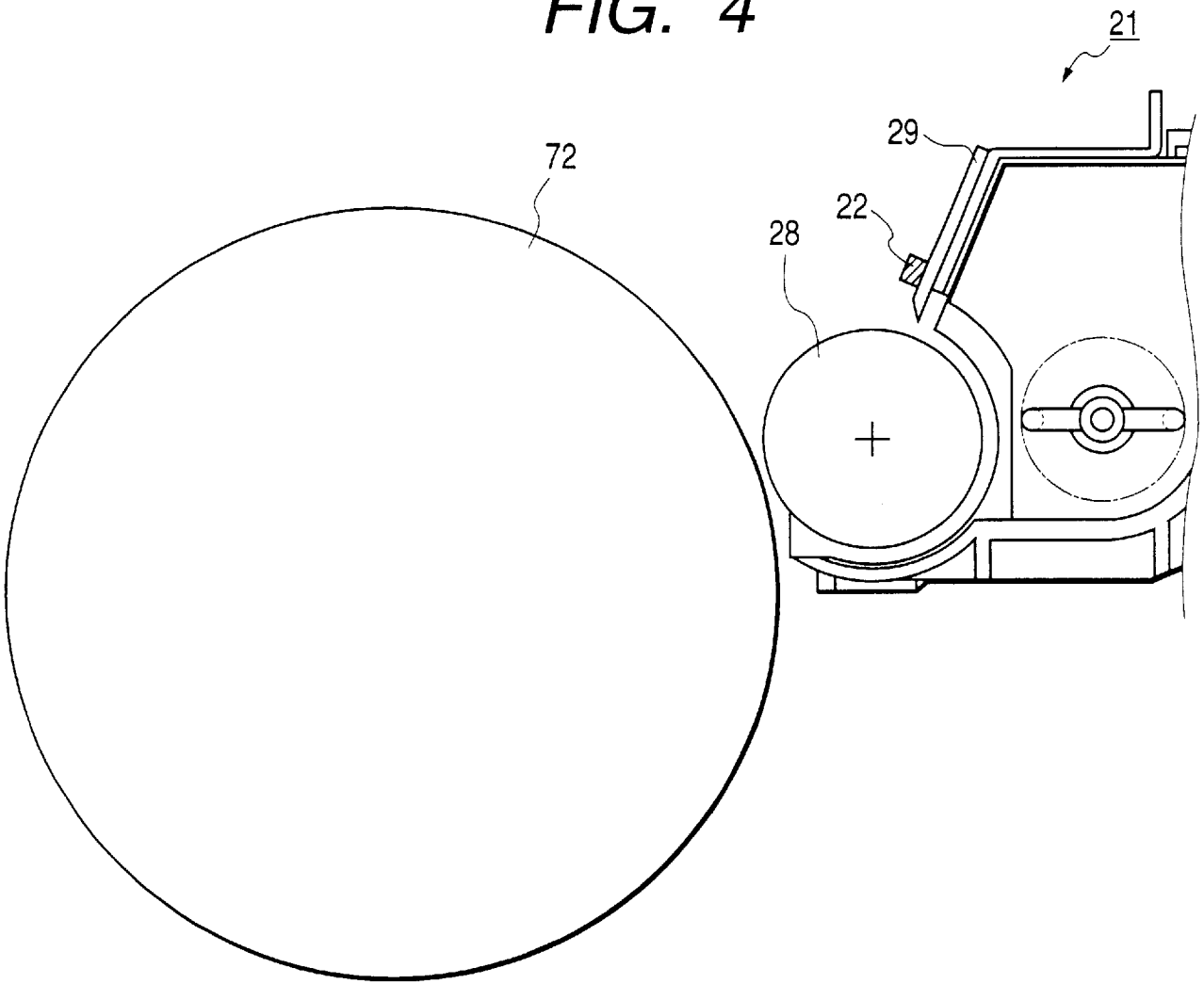
FIG. 4 is a partly cross-sectional view showing the construction of a developing apparatus according to Embodiment 2 of the present invention.

FIG. 4 is a cross-sectional view showing the developing sleeve and developing blade portions of a developing apparatus according to the present embodiment. In the other points, the construction of this developing apparatus is similar to that of the aforedescribed Embodiment 1.

In the developing apparatus 21 shown in FIG. 4, the reference numeral 29 designates a developing blade, the reference numeral 28 denotes a developing sleeve, and the reference numeral 72 designates a photosensitive drum, and the procedure for developing a latent image formed on the photosensitive drum 72 is similar to that in Embodiment 1.

Also, the reference numeral 22 denotes a heat pipe, and this heat pipe 22 is fixed to the developing blade 29 by mechanical means such as caulking or brazing.

In a medium or low speed machine to which the present embodiment can be applied, it is not necessary to add 9 heat sink for radiation cause as previously described, developing frictional contact heat is not so great as in the high-speed machine.

However, when as in Embodiment 1, the vicinity of the developing blade 29 is cooled by a cooling fan, not shown, the temperature distribution in the lengthwise direction of the developing blade 29 will become nonuniform.

However, as in the present embodiment, the heat pipe 22 is fixed in contact with the developing blade 29, whereby the cooling action for the developing blade 29 by the cooling fan or the like can be uniformly exerted upon the whole area of the developing blade 29 in the lengthwise direction thereof, and this can contribute to the uniformization of the quality of image.

As is apparent from the foregoing description, according to the present invention, in a developing apparatus provided with a developing sleeve carrying a developer thereon and rotated, a developing blade uniformly provided with a slight gap between it and the surface of the developing sleeve and for thinly coating the surface of the developing sleeve with the developer, a heat sink for radiation in contact with the developing blade, and cooling means for cooling the heat sink for radiation, a heat pipe is embedded in the heat sink for radiation or the heat pipe is secured to the developing blade and therefore, there can be obtained the effect that the temperature rise of the developing blade can be restrained and also the temperature of the developing blade in the lengthwise direction thereof can be uniformized.

While the embodiments of the present invention have been described above, the present invention is not restricted to these embodiments, but all modifications within the technical idea of the present invention are possible.

What is claimed is:

1. A developing apparatus comprising:

a developer carrying member for carrying a developer thereon;

a regulating member for regulating an amount of the developer on said developer carrying member; and a heat pipe provided along a lengthwise direction of said regulating member.

2. A developing apparatus according to claim 1, further comprising air blowing means for blowing air toward an end portion of said regulating member in the lengthwise direction.

3. A developing apparatus according to claim 1, wherein said developer carrying member is provided in opposed relationship with an image bearing member for bearing an electrostatic image thereon, and said heat pipe is provided on a surface of said regulating member which is adjacent to said image bearing member.

4. A developing apparatus according to claim 1, further comprising a heat sink for radiation provided in contact with said regulating member, wherein said heat pipe is embedded in said heat sink.

* * * * *